United States Patent [19]

Wood

[11] Patent Number: 4,458,836

[45] Date of Patent: Jul. 10, 1984

[54] ARTICLE WRAPPER

[75] Inventor: Prentice J. Wood, Hapeville, Ga.

[73] Assignee: The Mead Corporation, Dayton, Ohio

[21] Appl. No.: 435,036

[22] Filed: Oct. 18, 1982

[51] Int. Cl.[3] ..... B65D 5/04

[52] U.S. Cl. ..... 229/40; 229/48 R

[58] Field of Search ..... 229/40, 39 R; 206/140, 206/434, 435

[56] References Cited

U.S. PATENT DOCUMENTS

| | | | |
|---|---|---|---|
| 3,223,308 | 12/1965 | Weiss | 229/40 |
| 3,655,117 | 4/1972 | Weiss | 229/40 |
| 3,963,170 | 6/1976 | Wood | 229/40 |
| 4,093,116 | 6/1978 | Watkins | 229/48 R |
| 4,330,079 | 5/1982 | Wood | 229/40 |

*Primary Examiner*—Herbert F. Ross

*Attorney, Agent, or Firm*—Rodgers & Rodgers

[57] ABSTRACT

An article wrapper which is especially adapted for use in packaging articles which are of cube shape includes top, bottom and side walls foldably joined together so as to form a tubular structure, one wall such as the bottom wall comprising overlapping lap panels, an anchoring aperture formed in the inner one of said lap panels, a securing slit formed in general coincidence with the fold line between said inner lap panel and the associated side wall, and a locking tab having a body portion, a heel portion, and a toe portion and being struck from the outer one of said lap panels and being folded through an angle of approximately 180° and into face contacting relation with the part of the outer lap panel which is remote from the associated side wall and so as to cause the heel portion to enter the anchoring aperture and to cause the toe portion to enter the securing slit thereby to interlock the lap panels in face contacting relation with each other.

11 Claims, 3 Drawing Figures

ARTICLE WRAPPER

TECHNICAL FIELD

This invention relates primarily though not exclusively to the packaging of articles which are of cube shape configuration and concerns improved means for interlocking the lap panels at the ends of a generally rectangular blank in secure overlapping relation with each other so as to form a tubular structure disposed about a plurality of articles.

BACKGROUND ART

U.S. Pat. No. 4,330,079 issued May 18, 1982 discloses a wrapper in which lap panels are formed at the ends of a blank and wherein locking tabs each having a main body-portion, a heel portion and a toe portion are struck from one lap panel and wherein locking apertures are formed in the other lap panel, each locking aperture including an anchoring edge and a securing edge spaced from the anchoring edge and generally parallel thereto.

Structure such as is disclosed and claimed in U.S. Pat. No. 4,330,079 is well suited for use in packaging articles such as bottles and cans used as primary packages for consumer products and which are small in physical size and thus light in weight. This type of structure is not well suited for use in packaging primary packages which are large and heavy due to the fact that the locking tab is small and thus not very strong mechanically.

DISCLOSURE OF THE INVENTION

According to this invention in one form, an article wrapper is provided in which lap panels are formed at the ends of the blank and in which a heel and toe type locking tab is struck from the outer lap panel and wherein an anchoring aperture is formed in the inner lap panel for receiving the heel of the locking tab during a locking operation and wherein a securing slit for receiving the toe of the locking tab is formed in general coincidence with the fold line between the inner lap panel and its associated side wall.

BEST MODE OF CARRYING OUT THE INVENTION

Figure 1:
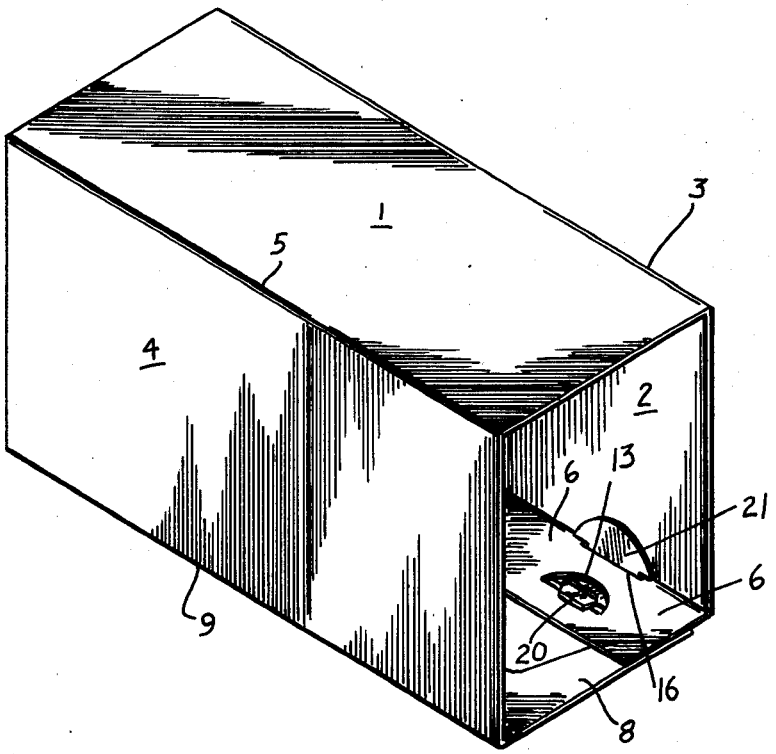
FIG. 1 is an isometric view of an article wrapper formed according to the invention and which is shown in set-up condition but with the packaged articles removed for clarity.
Figure 2:
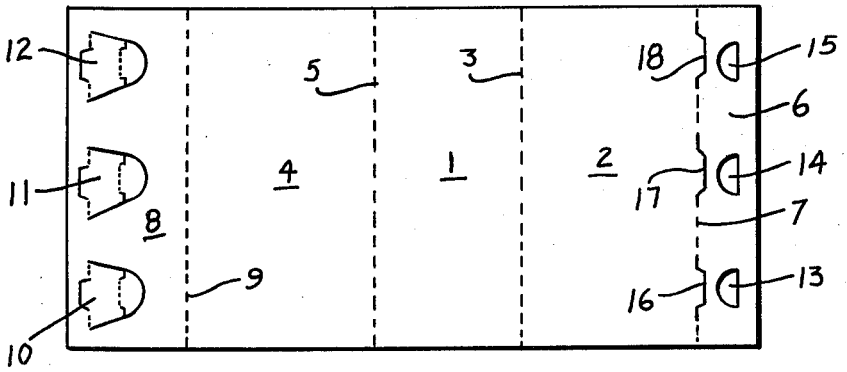
FIG.2 is a plan view of a blank from which the wrapper shown in FIG. 1 is formed and FIG. 3 includes views from below and designated A, B and C, depicting sequential stages through which the interlocking means formed according to this invention is manipulated in order to form the completed lock as shown from below in FIG. 3D.

In the drawings the numeral 1 generally designates the main central panel of the blank and is sometimes herein referred to as the top wall of the wrapper although it will be understood that the term top wall is used in a general sense and that the wall 1 conceivably could constitute a bottom wall or even a side wall depending upon the orientation of the package. Side wall 2 is foldably joined to top wall 1 along fold line 3 while side wall 4 is foldably joined to a side edge of top wall 1 along fold line 5. Inner lap panel 6 is foldably joined to side wall 2 along the interrupted fold line by the numeral 7 while outer lap panel 8 is foldably joined to side wall 4 along fold line 9.

Locking tabs 10, 11 and 12 are struck from lap panel 8 while anchoring apertures 13, 14, and 15 are struck from lap panel 6. Securing slits 16, 17 and 18 are struck from lap panel 6 and are in general coincidence with the fold line 7 between side wall 2 and lap panel 6.

All of the locking tabs, as well as all of the anchoring apertures and securing slits are identical in configuration and in operation. Only one set of locking tabs such as 10 and the associated anchoring aperture such as 13 as well as the securing slot 16 are here described in detail. Thus with reference to FIG. 3A locking tab 10 includes a body portion 19, a heel portion 20 and toe portion 21. Body portion 19 is foldably joined to lap panel 8 along aligned fold lines 22 and 23 while toe portion 21 is foldably joined to body portion 19 along fold line 24. Arcuate slots 25 and **25*a* extend from the ends of fold line 24** to the edges of the locking tab as is apparent from FIG. 3A.

Figure 3:
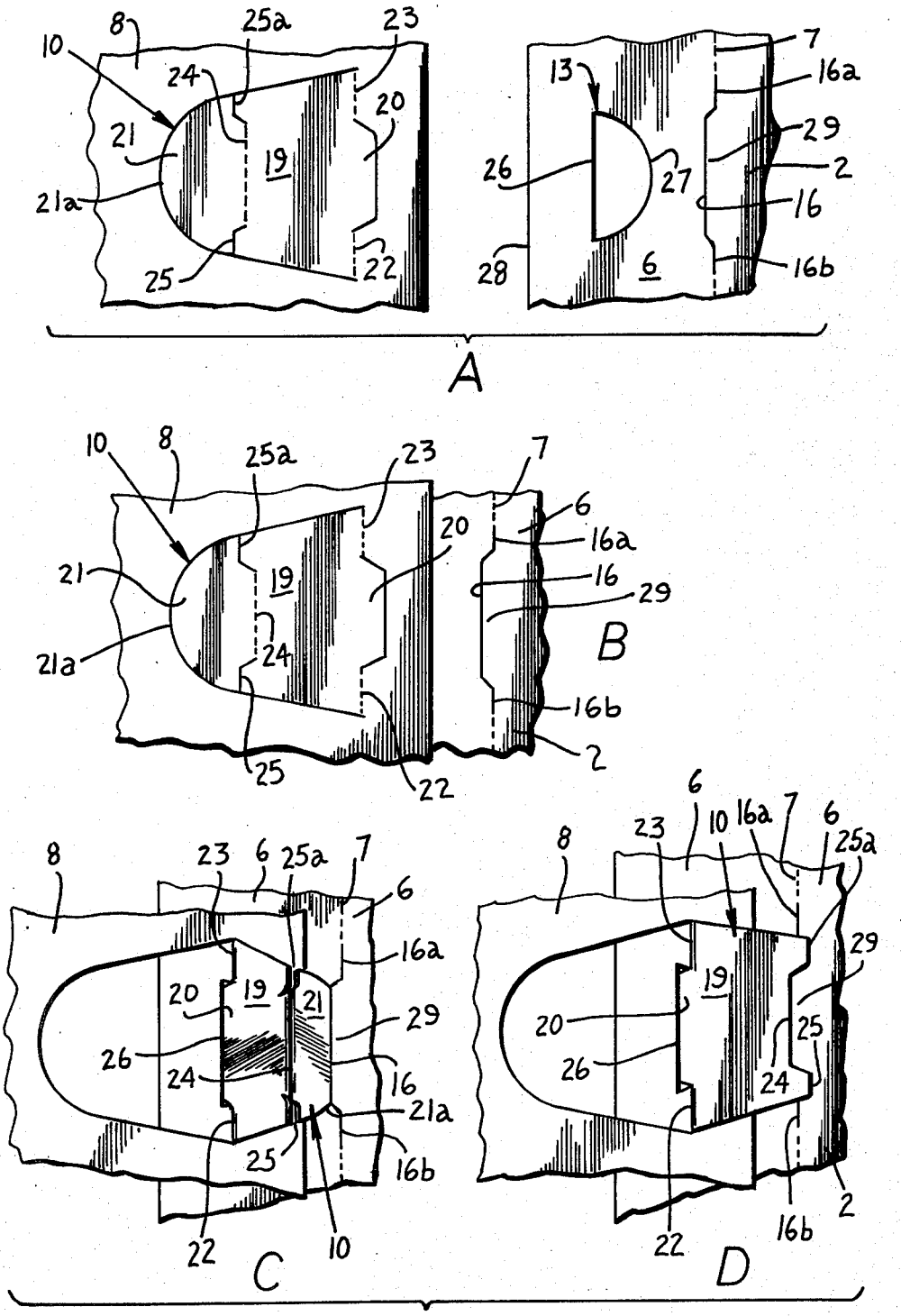

As is apparent from FIG. 3A anchoring aperture 13 is of generally semi-circular configuration and includes a straight line 26 and a semi-circular line 27. Line 26 is generally parallel with the end edge 28 of lap panel 6.

Slit 16 preferably is defined by a projecting portion 29 of side wall 2 which in effect is struck from lap panel 6. For some application of the invention slit 16 may be disposed astride fold line 7 and with the end slits **16*a* and 16*b* struck from side wall 2**.

Views 3B and 3C depict stages through which the locking tab is manipulated as shown from below, i.e., from the bottom of the package when the package is oriented as shown in FIG. 1.

With the articles to be packaged arranged in a group to form a generally rectangular configuration, the top panel 1 is arranged in overlying relationship with the group of articles and the side walls 2 and 4 are folded downwardly. Thereafter the inner lap panel 6 is folded inwardly underneath the group of articles and the outer lap panel 8 is folded underneath the group of articles into overlapping relation with the inner lap panel 6 so that the parts then occupy the position depicted in FIG. 3B. Body portion 19 of the locking tab is swung downwardly out of the plane of lap panel 8 so as to cause the heel portion 20 to enter the anchoring aperture 13. Toe portion 21 is folded out of the plane of body portion 19 and enters the securing slit 16 as represented in FIG. 3C. During this operation, the projecting portion 29 of side wall 2 is engaged by the end portion **21*a* of the toe 21 and by this means the toe 21 is guided into the slit 13. It will be obvious that FIG. 3C is a view taken somewhat to one side so as to depict the lower portion of side wall 2** as well as the parts which constitute the locking mechanism.

Thereafter the body portion 19 of the locking tab is pressed toward the part of lap panel 8 which is disposed between the end edge 30 thereof and the fold lines 22 and 23 so as in effect to envelop that edge portion 30 of lap panel 8. Of course the edge portion of lap panel 8 is secured in flat face contacting relation with the lower surface of lap panel 6. The body portion 19 of locking tab 10 is then disposed in close underlying generally parallel relation with the portion of the inner lap panel 6 which is disposed between anchoring aperture 13 and securing slit 16. The completed lock then appears as shown in FIG. 3D. FIG. 3D like FIG. 3C is taken toward one side so as to depict the lower portion of side wall 2 as well as the locking element in completed locked condition. Since the securing slit 16 is spaced a substantial distance from edge 26 of anchoring aperture 13, the body portion 19 is large when compared to the corresponding parts of similar locks and is thus characterized by substantial strength and easy machineability.

INDUSTRIAL APPLICABILITY

While the locks formed according to this invention are particularly well suited for use in conjunction with a wrapper used to package articles which are of cubed configuration with no voids, it is obvious that the invention is not limited to this particular use and may also apply very well to wrappers used to package articles of different configurations such as cylindrical articles for example.

I claim:

1. An article wrapper comprising a top wall, a pair of side walls foldably joined respectively to the side edges of said top wall, a pair of overlapping lap panels foldably joined respectively to the bottom edges of said side walls, an anchoring aperture formed in the inner one of said lap panels in spaced relation to the associated side wall, a securing slit separate from said anchoring aperture and formed in general coincidence with the fold line between said inner one of said lap panels and the associated side wall and spaced from said anchoring aperture, and a locking tab having a body portion, a heel portion, and a toe portion and being struck from the outer one of said lap panels and folded through an angle of approximately 180° and into face contacting relation with the part of said outer lap panel which is remote from the associated side wall and so as to cause said heel portion to enter said anchoring aperture and to cause said toe portion to enter said securing slit so that when the lock is formed the body portion of said locking tab is disposed in enveloping face contacting relation with the edge portion of said outer lap panel which is remote from the associated side wall and the body portion of said locking tab is disposed in close underlying generally parallel relation with the portion of said inner lap panel which is disposed between said anchoring aperture and said securing slit.

2. An article wrapper according to claim 1 wherein said toe portion of said locking tab is foldably joined to said body portion thereof and wherein said toe portion is disposed in substantially flat face contacting relation with the one of said side walls, which is foldably joined with the inner one of said lap panels.

3. An article wrapper according to claim 1 wherein one edge of said securing slit is defined by a projecting portion of the side wall which is foldably joined to said inner lap panel.

4. An article wrapper according to claim 3 wherein said projecting portion of the side wall which is foldably joined to said inner lap panel is struck from said inner lap panel.

5. An article wrapper according to claim 3 wherein said toe portion of said locking tab is engaged and guided into said securing slit by said projecting portion of the side wall which is foldably joined to said inner lap panel.

6. An article wrapper according to claim 1 wherein said anchoring aperture is of substantially semi-circular configuration with the straight line portion thereof generally parallel with and adjacent the edge of said inner lap panel which is remote from the associated side wall.

7. An article wrapper according to claim 6 wherein said body portion of said locking tab is foldably joined to said outer lap panel by a pair of aligned fold lines disposed on opposite sides of said heel portion of said locking tab and in generally parallel relation and in close proximity ot said straight line portion of said anchoring aperture when said lap panels are interlocked.

8. A generally rectangular blank for an article wrapper comprising a main central wall, a pair of side walls foldably joined to the side edges respectively of said main central wall and a pair of lap panels foldably joined to said side walls respectively along edges thereof which are remote from said main central wall, at least one anchoring aperture formed in one of said lap panels in spaced relation to one of said side walls and having an anchoring edge arranged in generally parallel relation to the end edge of said one lap panel, at least one securing slit separate from said anchoring aperture and formed in general coincidence with the fold line between said one lap panel and the associated side wall and spaced from said anchoring aperture, at least one locking tab struck from the other of said lap panels and including a body portion foldably joined thereto by a pair of aligned fold lines, a heel portion formed integrally with said body portion and projecting outwardly toward the end edge of said other lap panel, and a toe portion foldably joined to said body portion and projecting inwardly toward the inner edge of said other lap panel.

9. A blank according to claim 8 wherein said anchoring aperture is of generally semi-circular configuration.

10. A blank according to claim 8 wherein said securing slit is defined along one side by a projecting portion of the associated side wall.

11. A blank according to claim 10 wherein said projecting portion of said side wall is struck from said one lap panel and wherein said projecting portion is defined by an edge and a pair of side edge portions which project outwardly respectively from the ends of said end edge.

* * * * *